US005520082A

United States Patent [19]

Armstrong et al.

[11] Patent Number: 5,520,082

[45] Date of Patent: May 28, 1996

[54] TREMOLO BRIDGE FOR GUITARS

[76] Inventors: Kent Armstrong, Hazeldene, Nickley Wood Road, Shadoxhurst, Near Ashford, Kent TN26 1LZ; Ian A. Bottle, 84 Sandwich Rd., Whitfield, Dover, Kent CT16 3LY, both of England

[21] Appl. No.: 367,005

[22] Filed: Dec. 30, 1994

[51] Int. Cl.[6] ..... G10D 3/00

[52] U.S. Cl. ..... 84/313

[58] Field of Search ..... 84/298, 307, 313

[56] References Cited

U.S. PATENT DOCUMENTS 4,632,005 12/1986 Steinberger ..... 84/313

*Primary Examiner*—Patrick J. Stanzione
*Attorney, Agent, or Firm*—Bauer & Schaffer

[57] ABSTRACT

The invention is a tremolo device for adjusting the string tension in a stringed musical instrument including a body having an upper surface, a neck portion, a tuning head having a series of tuning devices, a multiplicity of strings each anchored at a first end to a respective one of the tuning devices and extending over at least a portion of the neck portion and the body. The tremolo device includes a base plate attached to the body of the instrument and a movable plate having first and second edges extending in a direction perpendicular to the strings. The movable plate is mounted to the base plate along the second edge of the movable plate about a pivot axis and in a horizontal position with its longitudinal axis perpendicular to the strings. The first edge of the movable plate is adapted to securely anchor the second end of each of the strings. The tuning devices are manually operable to stretch the associated strings between itself and the movable plate to apply a preselected tension force to each of the strings which bias the movable plate in a first direction of rotation about the pivot axis. A biasing member is connected between the base plate and the movable plate for biasing the movable plate about the pivot axis in a second direction of rotation opposite the first direction. An actuating arm is attached to the movable plate to allow rotation of the movable plate in one of the first and second directions of rotation to adjust the tension of the strings.

12 Claims, 9 Drawing Sheets

TREMOLO BRIDGE FOR GUITARS

FIELD OF THE INVENTION

The present invention relates generally to stringed musical instruments and, more particularly, to a tremolo device for supporting the strings of the instrument and for enabling pitch adjustment of the strings.

BACKGROUND OF THE INVENTION

Tremolo devices have been used for many years with stringed musical instruments for creating a vibrato sound. Various structures have been proposed and utilized in the prior art for this purpose.

Broadly, a tremolo mechanism provides a means for changing the tension on all of the strings of the instrument simultaneously to create a pitch change during vibration of the strings. Typically, on many such string instruments as guitars, the bridge is mounted for enabling manual pivoting to thereby simultaneously change the pitch (tension) of all the strings to produce a vibrato effect, which is a steady oscillating variation of pitch about a primary frequency being perhaps the frequency most frequently used by guitarist. That is, each string has a primary tension, at which it has a desired primary pitch or tone. In such mechanism, the bridges are pivotally mounted to the instrument body and are maintained in a normal, string tensioned position by strong springs against the tension of the strings. A lever mounted to the bridge enables the instrument player to pivot the bridge and thus either increase the tension of each string above its primary tension to increase its pitch or relax it from its primary tension to decrease its pitch. Upon release of the lever, the springs return the bridge to the normal, static position for which the instrument is tuned.

A disadvantage with such prior art tremolo device is that the repeated and often violent tensioning and relaxing of the strings by operation of the bridge during playing of the instrument increases the friction in the tremolo device, preventing the strings from returning to their primary tension and pitch values and thus making it difficult for the instrument to be kept in tune. Furthermore, the life of the bridge is substantially decreased as it is continuously subjected to such pivoting action during desired production of a vibrato effect.

Another disadvantage encountered with prior art tremolo devices deals with the importance that the strings keep fixed positions relative to their strings supporting surfaces in order to maintain correct primary pitches. When the strings are at their primary tensions and pitches the force existing between each string and its string supporting surface tends to hold the string at a fixed position on the supporting surface. However, when the lever on the tremolo device is pivoted to relax the tension of the strings the force existing between each string and its string supporting surface is also reduced. Therefore, when this occurs a string may shift laterally away from its original position on its string supporting surface, and when the performer releases the lever the string may retain its laterally displaced position causing it to be de-tuned. Such situation is likely to occur when the tremolo device is operated to produce sound effects where the string tensions are relaxed to such degree that the strings become completely free of tension so as to be loose and able to move in a floppy manner relative to the tremolo device and other parts of the guitar.

Yet another disadvantage with prior art tremolo devices is that the strings are mounted on the bridge in such a manner so as to cause the tuning of the strings to be affected by pressure exerted thereof when musicians rest their hand or forearm on the bridge.

Accordingly, it is a primary object of the present invention to provide a tremolo device for stringed instruments which allows for the reduction of friction on the tremolo device to be reduced to the lowest possible amount permitting the strings to return to primary tension and pitch values.

It is a further object of the invention is to provide a tremolo device which avoids the possible de-tuning of the strings resulting from temporary relaxation of the string tensions through operation of the tremolo device.

Another object of the invention is to obviate the pressure exerted on the bridge from the musician's hand or forearm when rested thereon from affecting the tuning of the strings.

Additional objects and advantages of the invention will be set forth in part in the description which follows, and in part will be obvious from the description or be learned by practice of the invention.

SUMMARY OF THE INVENTION

Briefly stated, the present invention comprises a tremolo device for adjusting the string tension in a stringed musical instrument including a body having an upper surface, a neck portion, a tuning head having a plurality of tuning devices, a plurality of strings each anchored at a first end to a respective one of said plurality of tuning devices and extending over at least a portion of said neck portion and said body. The tremolo device comprises a base plate attached to the body of the musical instrument, a biasing plate including front and rear edges extending perpendicularly to the strings and means along the rear edge for anchoring the second end of each of the strings. The biasing plate is mounted on the base plate along the front edge of the biasing plate about a pivot axis and in a horizontal position with its longitudinal axis perpendicular to the strings.

The tuning devices are manually operable to stretch the associated strings between itself and the biasing plate to apply a preselected tension force to each of the strings which bias the movable plate in a first direction of rotation about the pivot axis. A biasing means is connected between the base plate and the movable plate for biasing the movable plate about the pivot axis in a second direction of rotation opposite to the first direction. Thus, the movable plate has a primary position defined by the counteracting tension forces applied to it by the strings and by the biasing means at which primary position the strings carry primary tension force values and have primary pitch values. A manually operable actuating arm is attached to the movable plate. Rotation of the actuating arm to rotate the movable plate in the first direction of rotation about the pivot axis to vary the tension forces and pitches of the strings from the primary values causes the biasing means to bias the movable plate in the second direction of rotation to return the movable plate to its primary position.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENT

While this invention is susceptible of embodiments in many different forms, this specification and the accompanying drawings disclose only some specific forms as examples of the use of the invention. The invention is not intended to be limited to the embodiments so described, and the scope of the invention will be pointed out in the appended claims.

Figure 1:
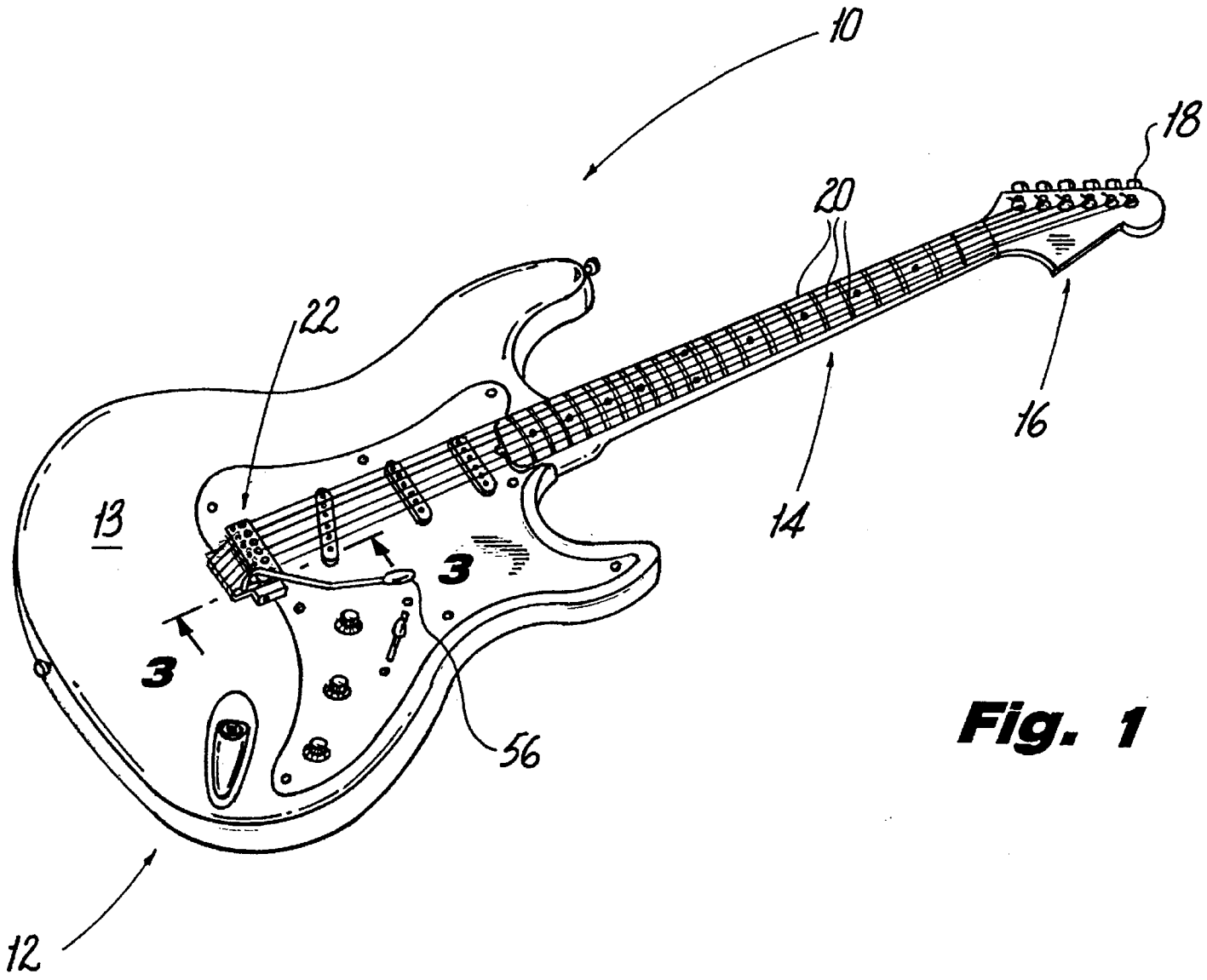
FIG. 1 is a perspective view of an electric guitar including a tremolo device in accordance with the present invention.

Referring now to the drawings in detail, wherein like numerals are used to indicate like elements throughout, there is shown in FIG. 1 a guitar, generally designated 10, embodying the present invention. The guitar 10 is a generally conventional electric guitar including a body 12 having an upper surface 13, a neck portion 14 extending outwardly from the body, a tuning head 16 having a plurality of tuning devices 18, a plurality of strings 20 anchored at one end to a respective one of the plurality of tuning devices and extending over the neck portion and the body, and anchored at its other end in the tremolo device of the present invention generally depicted by the numeral 22. Except for the tremolo device, the guitar 10 is conventional guitar of the type shown in U.S. Pat. No. 4,206,679 which details are hereby incorporated by reference herein.

The tremolo device 22 serves both as an anchor for the rear end of the strings 20 and as the bridge for such strings which individually extend from the tremolo device to a respective tuning device 18. The tuning device 18 is manually operable to apply a preselected tension force to each of the strings to bring them to a desired primary pitch. The primary tension forces and pitch values refer to the primary values or frequencies most commonly used by a performer. The tremolo device 22 also serves as a means enabling the performer to vary the primary tensions of the strings so as to introduce variable pitch effects, such as a vibrato effect, into the sound generated by the strings 20. The tremolo 22 is thus operable to selectively increase or decrease tension on the strings.

Figure 2:
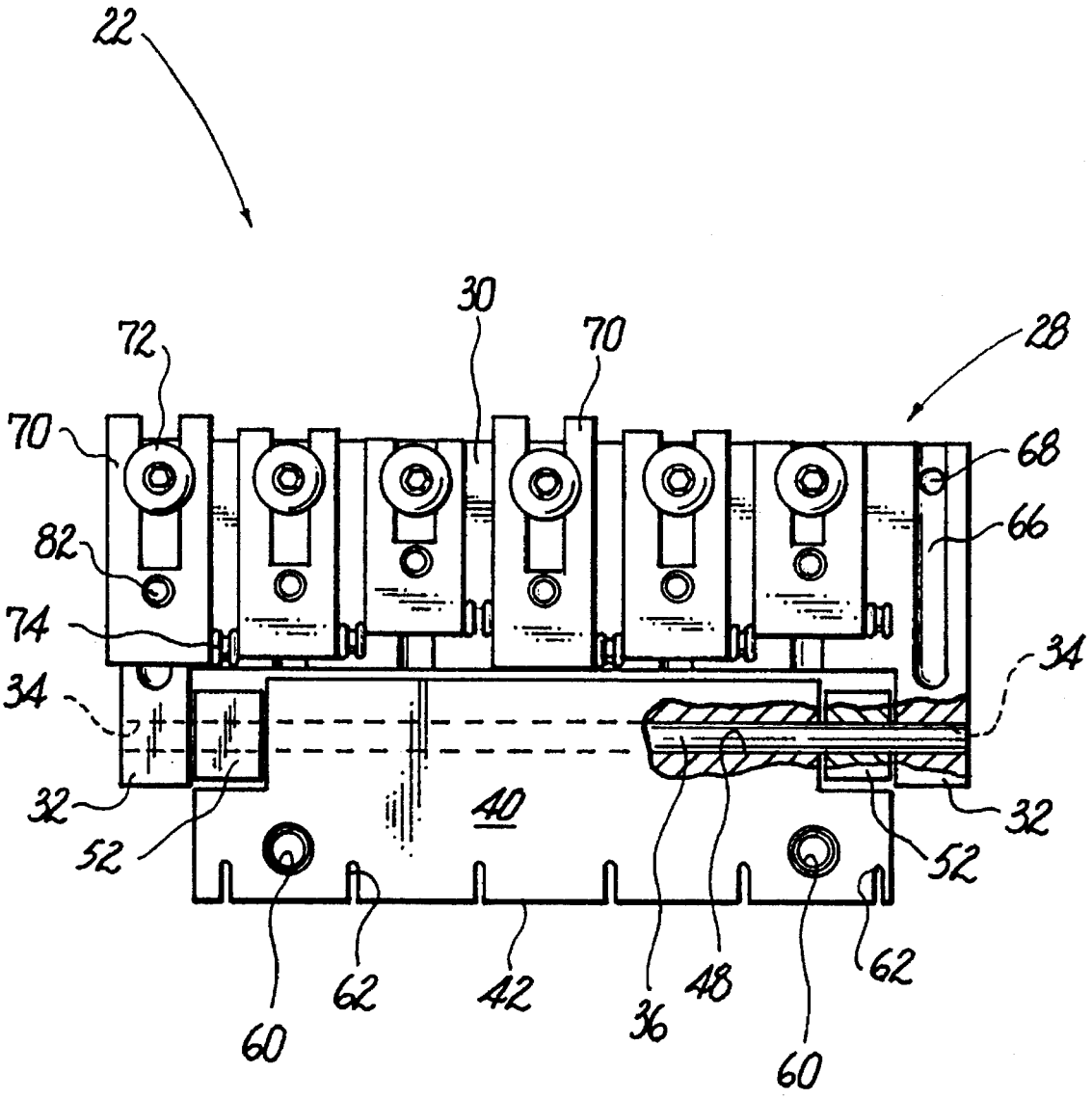
FIG. 2 is top plan view, partially in section, of the tremolo device in accordance with the present invention.
Figure 3:
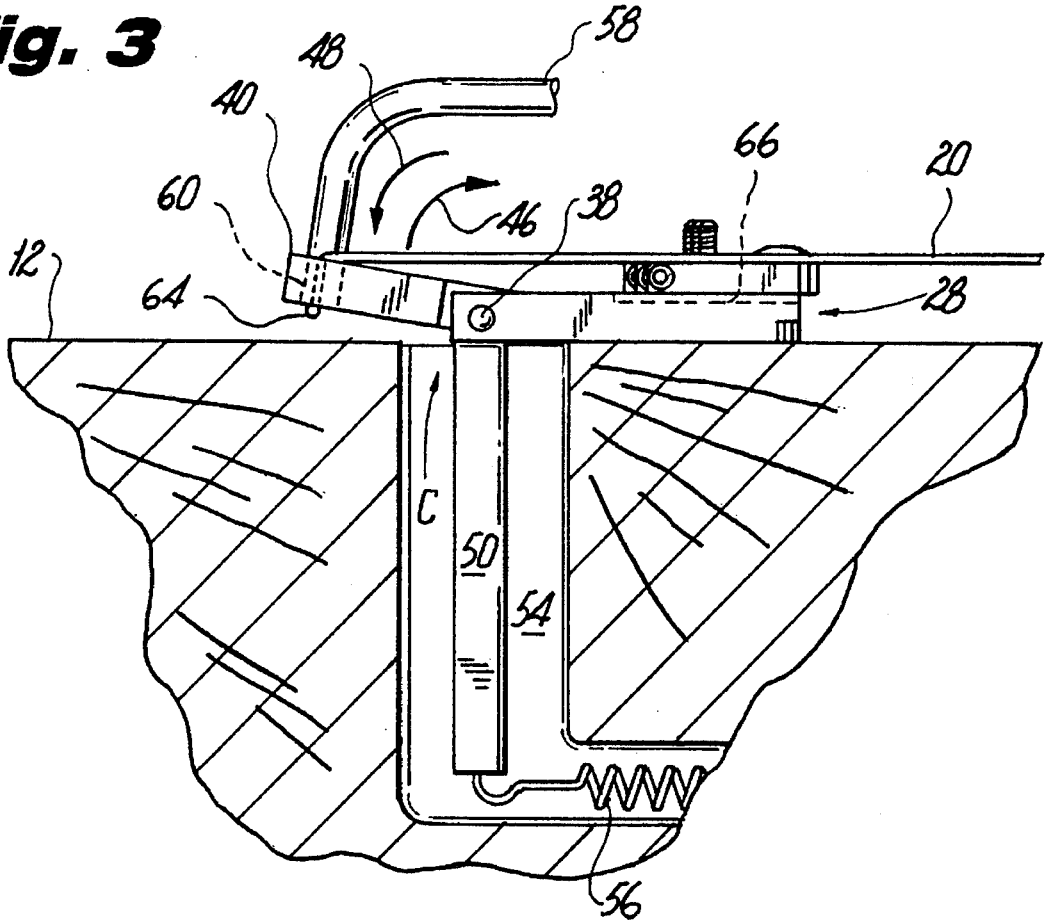
FIG. 3 is a cross-sectional view of the tremolo device shown in FIG. 1 taken along lines 3—3 of FIG. 1.

Referring now to FIGS. 2 and 3, the tremolo device 22 includes a base plate 28 fixed to the body 12 of the guitar 10 using suitable means, such as standard hardware as would be readily recognized by those of ordinary skill in the art without departing from the spirit and scope of the invention. The base plate 28 comprises a central section 30 having a pair of arms 32 extending perpendicularly thereto defining between the arms a recess. A pair of aligned bearing holes 34 are formed in the arms 32 and a pivot rod 36, as further described below, is received therein.

Mounted on the rod 36 between the arms 32 is a pivotal biasing plate 40 having a rear edge 42, in which a plurality of slots 44 are formed for anchoring the rear end of each of the strings 20. The plate 40 is cut back at each of the forward corners to extend into the recess defined by the arms 32 of the base plate 28 with the rod 36 passing through a bore 44. The biasing plate 40 is thus pivotally mounted to swing about the axis of the rod 36.

It will be appreciated by those skilled in the art that the tuning devices 18 are manually operable by a performer to apply a preselected tension force to each of the strings 20 acting on the movable biasing plate 40 for tuning purposes. These preselected tension forces act to rotatively urge the biasing plate 40 in a first, conventionally called the normal, direction toward the tuning devices 18 as depicted by the arrow referenced by the numeral 46.

The tremolo device 22 is additionally provided with means located between the base plate 28 and biasing plate 40 for biasing the biasing plate 40 about the pivot rod 36 in a second counterclockwise direction of rotation, depicted by the arrow referenced by the numeral 48. To this effect, an L-shaped crank assembly generally, depicted by the letter C, comprising the biasing plate 40 and a rectangular block 50 is provided. The block 50 has a pair of upstanding arms 52 which are pivotally hung from the pivot rod 36 so that the arms 52 seat between arms 32 of the base plate 28 and the corners of the biasing plate 40. The adjacent edges of the biasing plate 40 and block 50 are spaced by a small amount allowing a small degree of swing for each, but which will ultimately abut each other, in the nature of a bell crank whereby movement of one moves the other. At the bottom of the well 54, one end of a compression spring 56 is attached to the block 54 whil the other end (not seen) is attached to the body of the guitar. The compression spring 56 biases the block 50 and biasing plate 40 counterclockwise as seen by arrow 48. Thus, the counteracting tension forces applied to the biasing plate 40 by the strings and by the spring loaded crank assembly define a primary position of the movable plate in which the strings 20 have primary tension forces and primary pitch values as discussed above.

As explained in more detail hereinafter, the tremolo device 22 serves to enable the performer to controllably vary the tension forces of the strings 20 about their primary values to introduce variable pitch effects, such as vibrato, into the sound generated by the strings. To accomplish this purpose, an actuating arm 58 (FIG. 1) is removably attached to the biasing plate 40. Thus, for example, manipulation of the actuating arm 58 to rotate the movable plate 40 in the first or clockwise direction 46 results in the relaxation of the strings as the strings move toward the head 16. On the other hand, rotation of the biasing plate in the second or counter-clockwise direction 48 pulls the strings tighter from the head end.

The actuating arm 58 is threaded into a threaded opening 60 on an upper surface of the biasing plate 40 so as to extend in an arc over the fret board of the instrument. For convenience, the biasing plate 40 is provided with a threaded bores 60 at both the left and right ends thereof in order to enable left and right handed operation of the guitar 10 by either left, right or ambidextrous performers.

As seen in FIGS. 2 and 3, the rear end of each string 20 is anchored to the biasing plate 40 in one of a plurality of U-shaped recesses 62 positioned along the rear edge. Each of the recesses 62 is just wider than the diameter of its associated string 20. An anchoring element such as a ferrule 64 is attached to the rear end of the string 20 and engages the lower surface of the biasing plate 40 thus securing the string in its recess. The anchoring element may be a blob of metal welded at the end of the string or it may be a removable metal anchor. The details of the types of anchoring elements suitable to accomplish this purpose and the manner of securing the same to the string 20 are not pertinent to the present invention and are well understood by those skilled in the art. Accordingly, further description thereof is omitted for purposes of convenience only and is not limiting.

Figure 4:
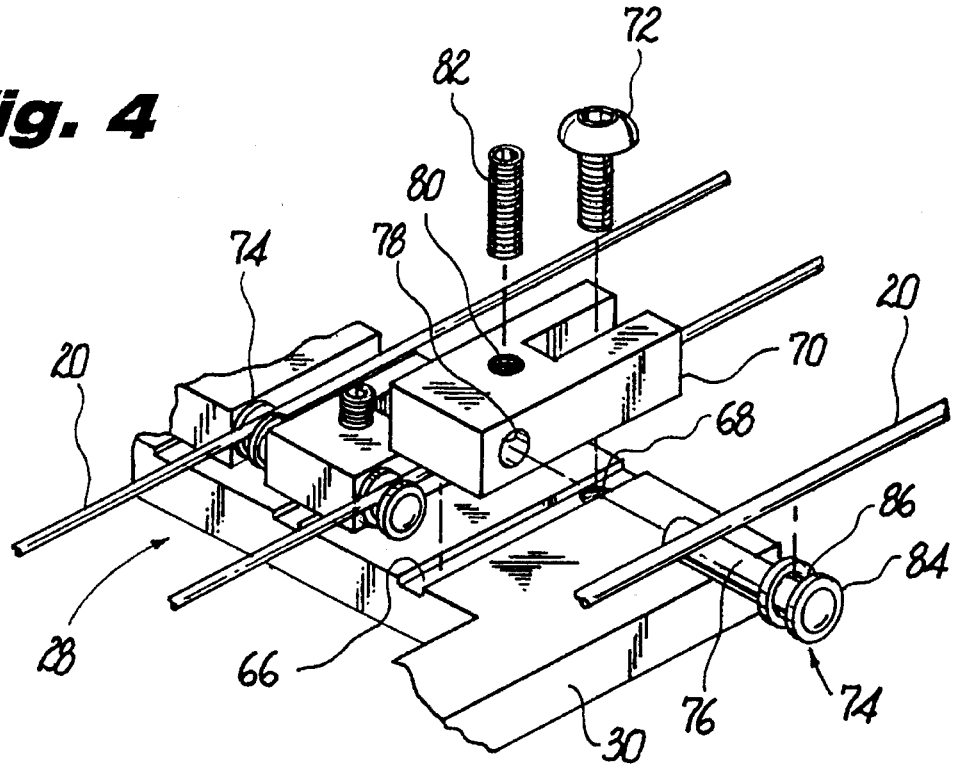
FIG. 4 is an enlarged plan view of one of the saddles of the tremolo device in accordance with the present invention.

As shown in FIGS. 2 and 4, the body 30 of the base plate 28 is provided with a number of slots 66 along its upper surface extending in a direction parallel to the strings 20. Each slot 66 includes a threaded opening bore 68 extending perpendicularly therethrough near its forward edge.

The base plate 28 is further provided with a number of U-shaped saddles 70 slidably secured to the base plate by means of a machine screw 72 extending into the threaded opening 68 (see FIG. 4). Each saddle 70 is provided with a string support 74 mounted at the end of a subshaft 76 fitting into a hole 78 extending at right angles to the direction of slot 66. The string support 74 is a wheel-like element having a central depressed section on which the string 20 rides. The support 74 is arranged to extend outwardly from the side of the saddle so as to be in alignment with the corresponding one of the recesses 62 on the rear edge of the bearing plate 40. Thus, each string 20 extends from a recess 62 over the string support wheel 74 of its associate saddle and thence to a respective one of said tuning devices 18 (FIG. 1). Finally, each U-shaped saddle 70 has a threaded opening 80 extending perpendicularly through its top surface receiving an elevational adjusting set screw 82.

The machine screw 72 is preferably a conventional screw with a head portion having a diameter greater than the width of the bight or distance between the arms of the U-shaped saddle 70 (FIG. 4) such that the head portion of the screw engages the arms of the saddle in order to compress the saddle into secure engagement with the base plate 28 when screwed into the opening 68. In this manner, the distance of the support wheel 74 from the head end 16 may be adjusted.

The elevational adjusting set screw 82 extends through the threaded opening 80 to engage the bottom of the slot 66 (FIG. 3). Thus, the set screw 82 may be used to adjust the height of the saddle 70, and thereby the string support surface 74 with respect to the base plate 28. Acting in cooperation with each other, the machine screw 72 and the set screw can also be used to adjust the forward to rear position of the saddle 70 as well as the height of the wheel.

The lateral adjustment of each saddle 70 is accomplished by first loosening the set screw 82 until it disengages contact with the bottom of slot 66. Thereafter, the machine screw 72 is loosened until the saddle 70 can move to and fro. The saddle is moved along the slot until a desired position is achieved and the set screw 82 and machine screw 72 are retightened to secure the saddle on the base plate 28 once again.

As described earlier, each of the saddles 70 rotatably supports a rotatable string support 74 which rotates about an axis extending perpendicularly to the strings 20 being rotatably supported on the shaft 76 fixed in hole 78 of the saddle body by press fit. Each support roller 74 includes two substantially flat side faces 84 between which annular depressed notch 86 defining a string supporting surface. The side faces 84 constitute guide surfaces on opposite sides of the string supporting surface 86 preventing the string from falling off.

If the actuating arm 58 is not manipulated or if it is moved only very slightly, the frictional forces existing between each string 20 and its string supporting roller 74 will normally retain the string in a fixed position. However, in prior art tremolo devices, if the actuating arm is operated in the forward direction 46 (FIG. 3) to severely relax the string tension, the strings will shift laterally of their string supporting surfaces and may not return to their original positions upon the movement of the biasing plate 40 to return it to its primary position. This produces tuning errors which the tremolo device of the present invention avoids.

From the foregoing it will be understood that when the biasing plate 40 is returned to its normal position, in which the strings have primary tension force values, the guide surfaces 84 of the rollers 74 will guide the strings back to its original position relative to the string supporting surface 86, and therefore the strings 20 will have the same primary pitches as when the biasing plate was previously in its primary position. It will further be observed, that the saddles 70 are of relatively low profile and do not hinder access to those portions of the strings located near their string supporting surfaces so that the performer is not hindered in engaging the strings with his hand at these areas for muting purposes.

Reference is now made to FIGS. 6–12 where there is shown tremolo devices incorporating modifying spring biasing means according to several different crank assembly embodiments. The several tremolo devices include the essential elements of the device previously described with reference to FIGS. 1–5 and detail modifications only to the spring means, weight block, etc. biasing the biasing plate the remaining structure and function are as previously disclosed.

Figure 5:
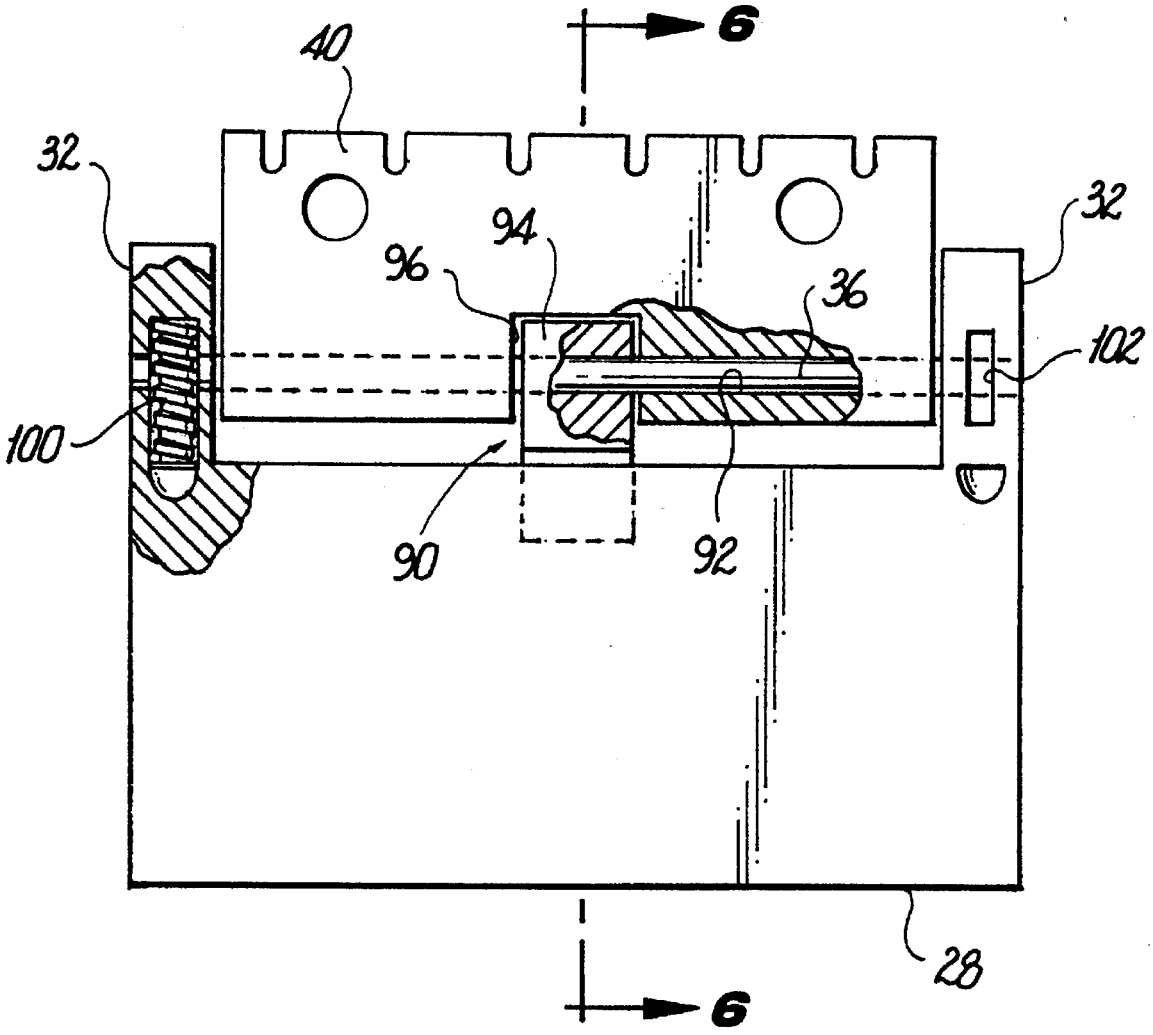
FIG. 5 is a top plan view of a first embodiment of a tremolo device in accordance with the present invention.

As illustrated in FIGS. 5, **6*a*, 6*b* and 6*c*, the biasing crank assembly comprises an L-shaped body 90 located centrally of the base plate 28 and the biasing plate 40 the latter of which is provided with a smaller recess than earlier shown. A bore 92 extends through the vertical leg 94 of the L-shaped body in a direction transverse to the strings 20. The pivot rod 36, here a torsion bar, extends through the bore 92 and through in the movable plate 40 and into the aligned holes in the arms 32 of the base plate 28. As can be seen in FIG. 5, the L-shaped body 90 extends partially into a recess 96 located along the forward edge and centrally of the biasing plate 40. The lower or horizontal leg 98 of the L-shaped body 90 extends downwardly into the well 54 formed in the upper wall 13 of the guitar. Coupled to each end of the pivot (torsion) rod 36 within the arms 32 of the base plate 28 is a worm and pinion tensioning device 100 urging the rod 36 in the counterclockwise direction of rotation 48 (FIG. 3). The tension means 100 counteracts the tension of the strings 20 in the clockwise direction of rotation 46 resulting in holding the bearing plate 40 in the primary position. The worm and pinion assembly is operated by a tool (not shown) inserted into the assembly through an opening 102 in the arms of base plate 28. (In FIG. 6, only one tensioning means 100 is illustrated, the other being identical.) It is understood by those skilled in the art that the tensioning means 100 could constitute any known tensioning device coupled to the rod 36**.

Figure 6A:
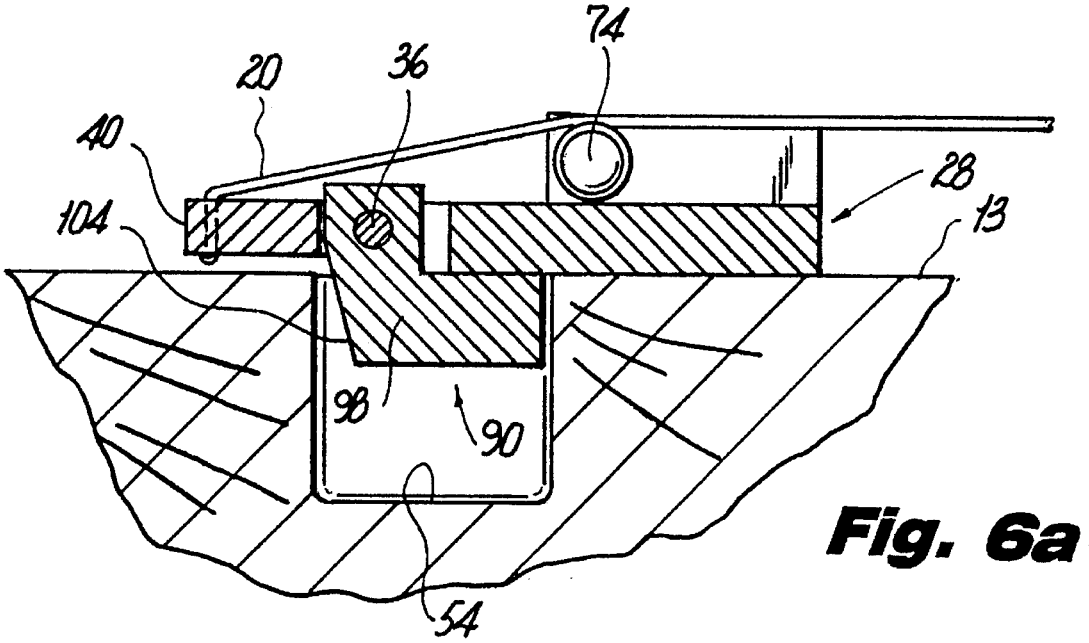
FIG. 6*a* is a fragmentary sectional view taken generally along lines 6—6 of FIG. 5 showing the tremolo device in its primary position.

Referring now to FIG. 6*a*, the horizontal leg portion 98 is tensioned by the worm and pinion assembly 100 to abut the base plate 28 at its front end. This tension force counteracts the string tension and by abutment of the vertical leg against the front edge of the biasing plate 40 keeps the plate 40 from rotating. As a result, the biasing plate 40 does not move relative to the base plate 28, thus the instrument is permitted to remain in tune even when one or more strings are broken.

Figure 6B:
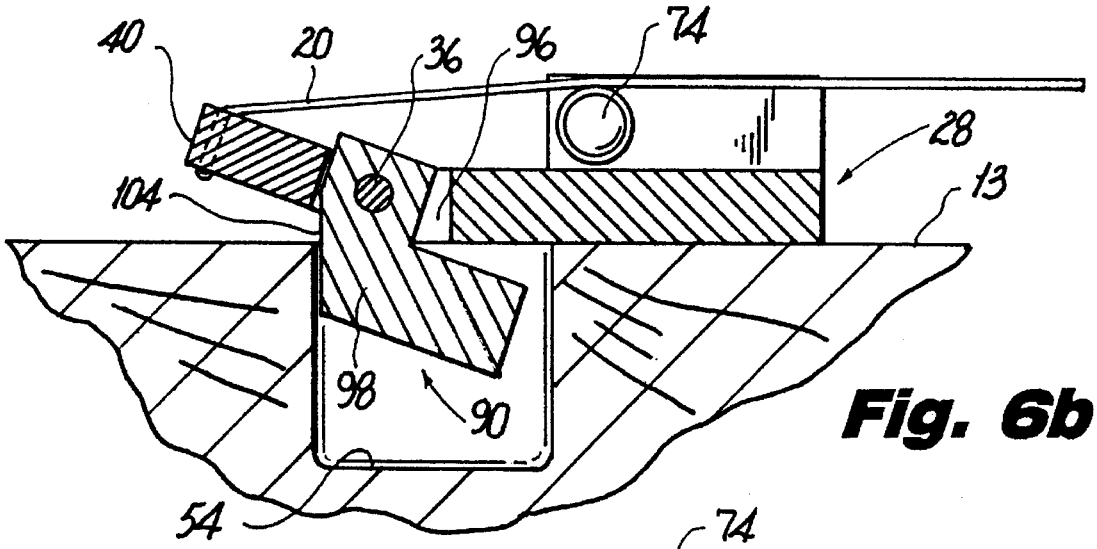
FIG. 6*b* is a fragmentary sectional view taken generally along lines 6—6 of FIG. 5 showing the tremolo device in a position at which the guitar strings are in a relaxed condition.

When the player desires to lower the tension, and hence the pitch mode, of the strings 20, the actuating arm 58 (FIG. 1) is caused to rotate the biasing plate 40 in the clockwise direction of rotation 46 overcoming the tension created by rod 36 and allowing the strings 20 to relax. This moves the L-shaped body 90 as a whole until the heel 104 of the L-shaped body hits the back wall of the well 54 (FIG. 6*b*). When the player subsequently relieves pressure on the actuating arm 58, the L-shaped body 90, being driven by the tensioned rod 36, causes the biasing plate 40 to return to its primary position shown in FIG. 6*a*. At this point, the forward and L-shaped body 90 once again abuts the base plate 28 preventing the overtensioning of the torsion bar 36 and prevents raising the pitch of the strings 20 above the desired tuning.

Figure 6C:
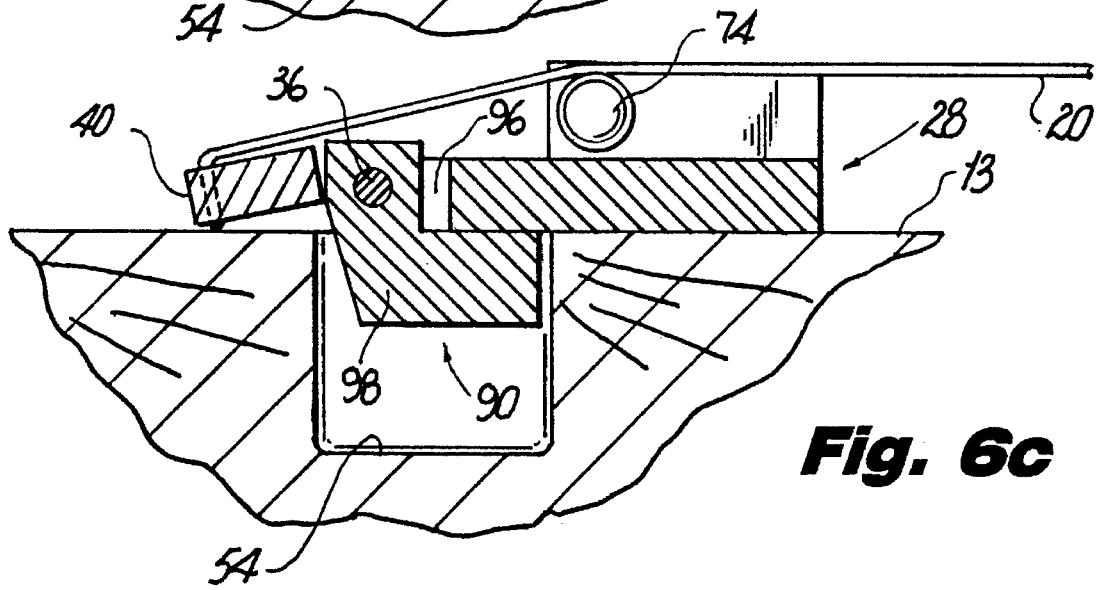
FIG. 6*c* is a fragmentary sectional view taken generally along lines 6—6 of FIG. 5 showing the tremolo device in a position at which the guitar strings are in a tensioned condition.
Figure 7:
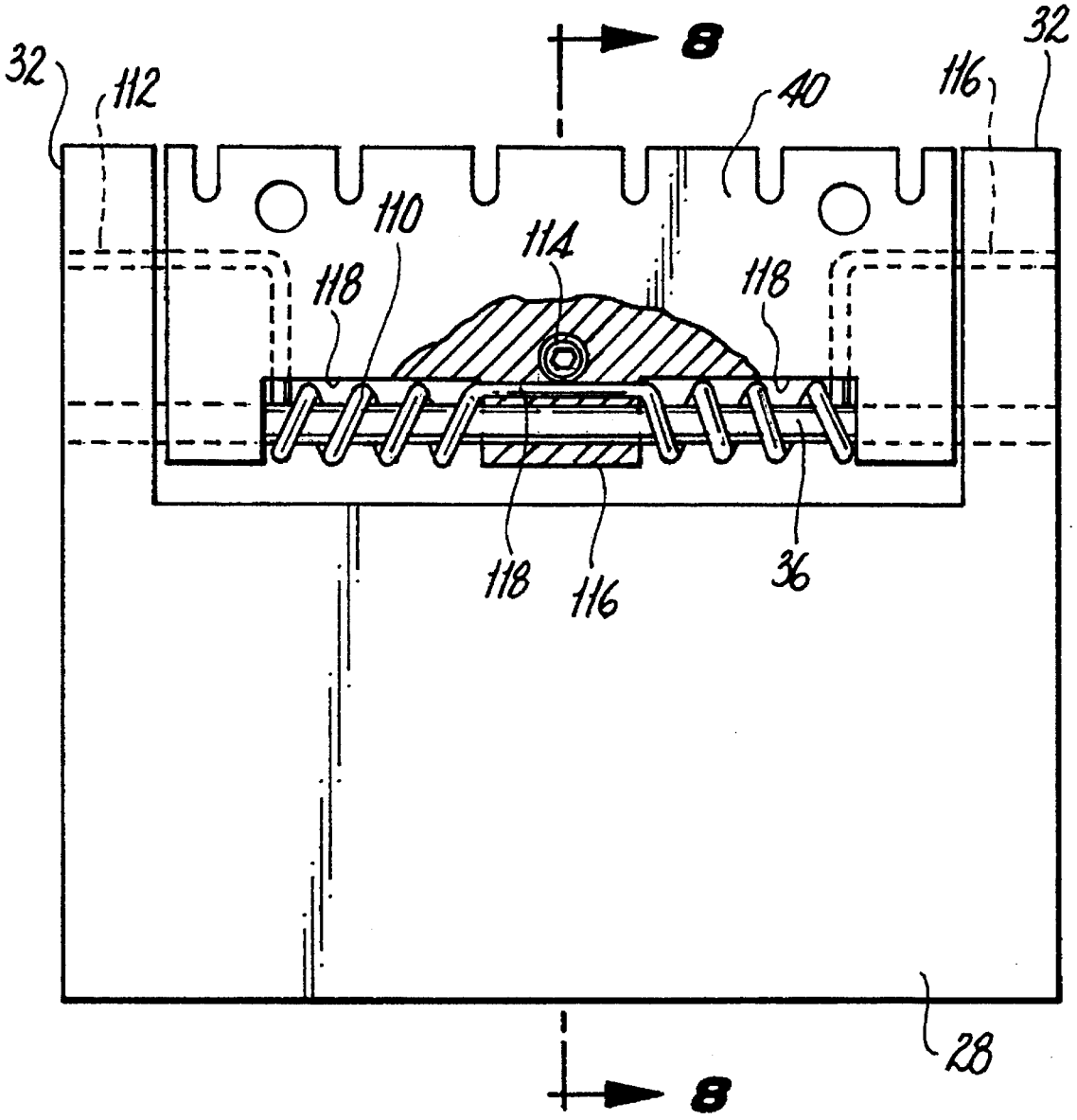
FIG. 7 is a top plan view of a second embodiment of a tremolo device in accordance with the present invention.

When it is desired to raise pitch mode of the strings 20, the player counter rotates the actuating arm 58 to rotate the biasing plate 40 in the direction of arrow 48 (FIG. 3) placing increased torsion on the rod 36. In this instance, the torsion on the pivot bar 36 has no effect on the L-shaped body 90 and the body is prevented from counter rotating by its abutment with the base plate 28 (FIG. 6*c*). However, movement of the biasing plate 40 causes the strings 20 to be stretched increasing their pitch. When the actuating arm is released, the biasing plate 40 is returned to its primary position shown in FIG. 7*a*, and hence the strings 20 to its primary pitch mode.

In another embodiment, as shown in FIGS. 7, 8*a*, 8*b* and 8*c*, includes the essential elements of the device previously described, although in this embodiment the crank assembly comprises a coil spring 110 wound around the pivot rod 36 and having each of its free ends 112 secured against the lower wall of the arms 32, respectively, of the biasing plate 28. The crank assembly includes a worm and pinion device 114 for tensioning the spring 110. In addition, the biasing plate 40 is provided, at its rear edge thereof, with a pair of adjacent rectangular recesses 118 straddling a central boss 116 through which the rod 36 passes. This allows the biasing plate 40 to clear the windings of the spring 110 and hence allow the biasing plate to rotate freely about the pivot axis 50 even against the bias of the spring. The worm and pinion device 112 is coupled to the center of the spring in a manner well recognized by those skilled in the art to allow for opening and closing of the coil windings.

Figure 8A:
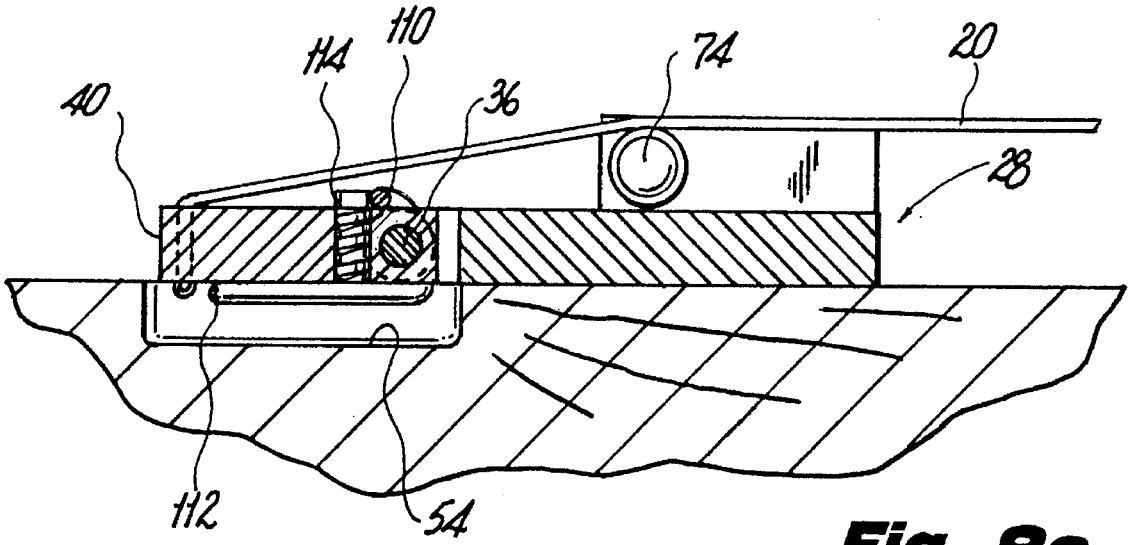
FIG. 8*a* is a fragmentary sectional view taken generally along lines 8—8 of FIG. 7 showing the tremolo device in its primary position.

FIG. 8*a* depicts the tremolo device 24 tuned in its primary position. The spring 110 is tensioned by the worm and pinion device 114 when the instrument is strung so that the spring 110 pulls the biasing plate 40 back until it bears against the ends 116 of the spring. Thus, if a string 20 breaks, or when tuning, the movable plate 40 does not move relative to the base plate 28.

Figure 8B:
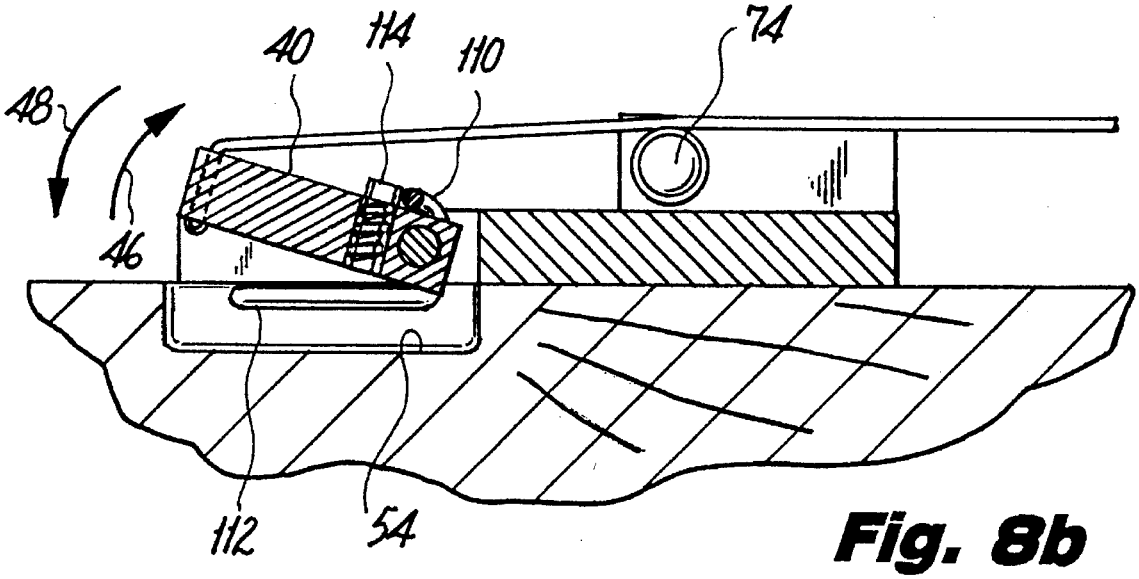
FIG. 8*b* is a fragmentary sectional view taken generally along lines 8—8 of FIG. 7 showing the tremolo device in a position at which the guitar strings are in a relaxed condition.

When a player desires to lower the tension of the strings 20, and hence the pitch mode, the actuating arm 58 is rotated in the clockwise direction of rotation 46. This causes the counter tension of the spring 110 to be overcome, thus allowing the biasing plate 40 to be lifted from the ends 116 of the spring, as seen in FIG. 8*b*, lowering the pull on strings 20, thereby lowering their pitch. When the player subsequently relieves the pressure on the actuating arm 58 the tension of the spring 110 drives the biasing plate 40 in the counterdirection until the latter abuts the ends 116 of the spring and thus returns the biasing plate to its primary position as shown in FIG. 8*a*. This causes the strings 20 to re-achieve its primary pitch values.

Figure 8C:
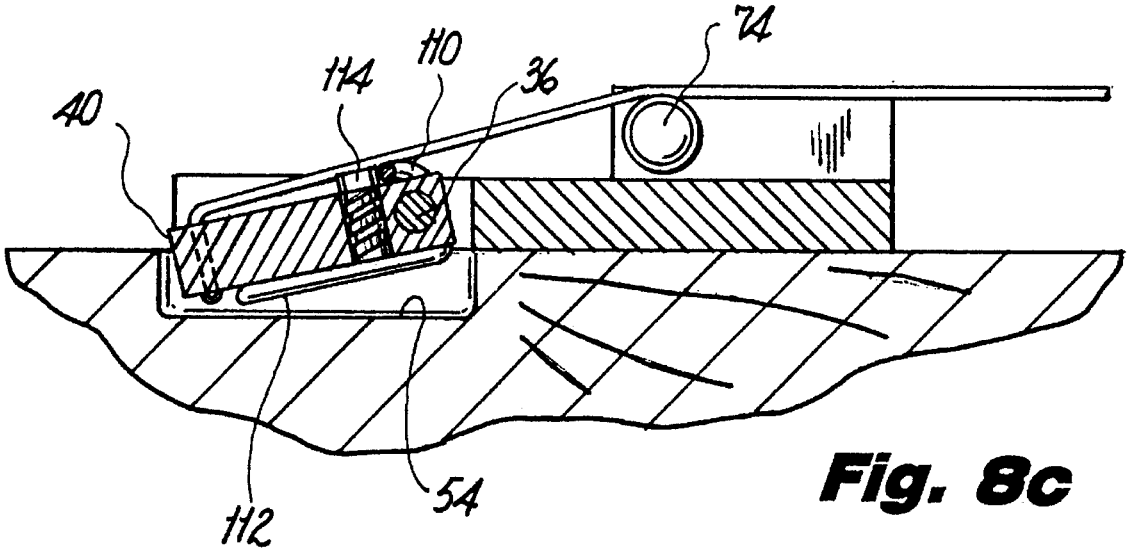
FIG. 8*c* is a fragmentary sectional view taken generally along lines 8—8 of FIG. 7 showing the tremolo device in a position at which the guitar strings are in a tensioned condition.

When it is desired to raise the pitch mode of the strings 20, the player counter rotates the actuating arm 58 to rotate the biasing plate 40 in the second direction of rotation 54, as shown in FIG. 8*c*, thus increasing the tension on the strings. In this instance the ends 116 of the spring 110 moves with the biasing plate 40 away from the base plate 28 into the well 54. When the player releases the actuating arm 56, the string tension pulls the biasing plate 40 back to its primary position (FIG. 8*a*).

Figure 9A:
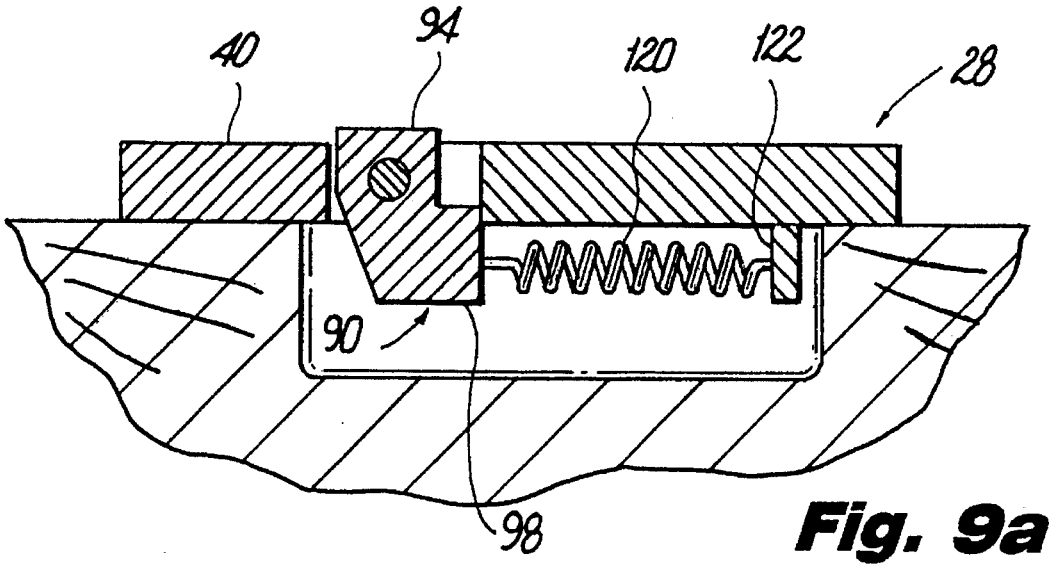
FIGS. 9*a*–9*c* are cross-sectional views similar to those of FIGS. 8*a*–8*c* showing a third embodiment of a tremolo device in accordance with the present invention.
Figure 9B:
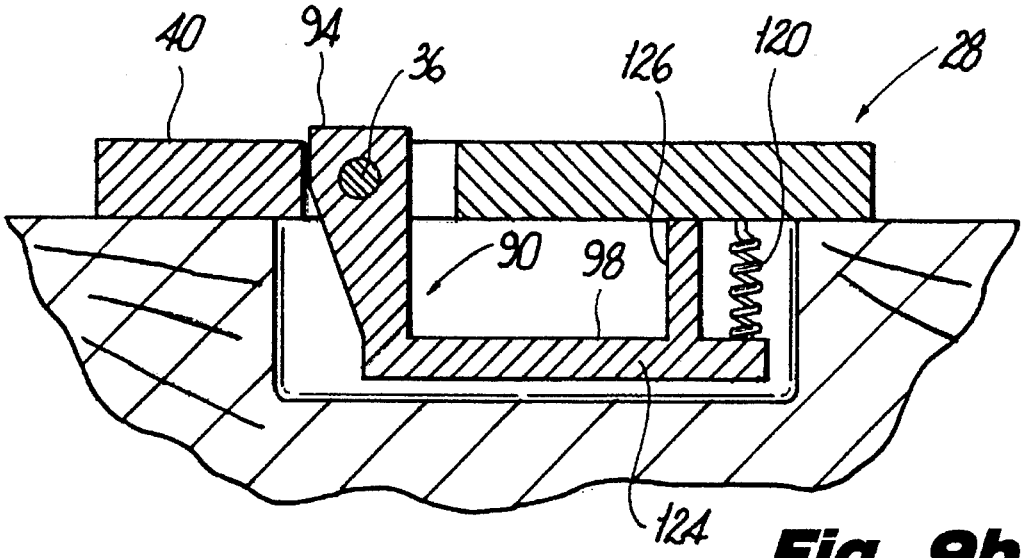
Figure 9C:
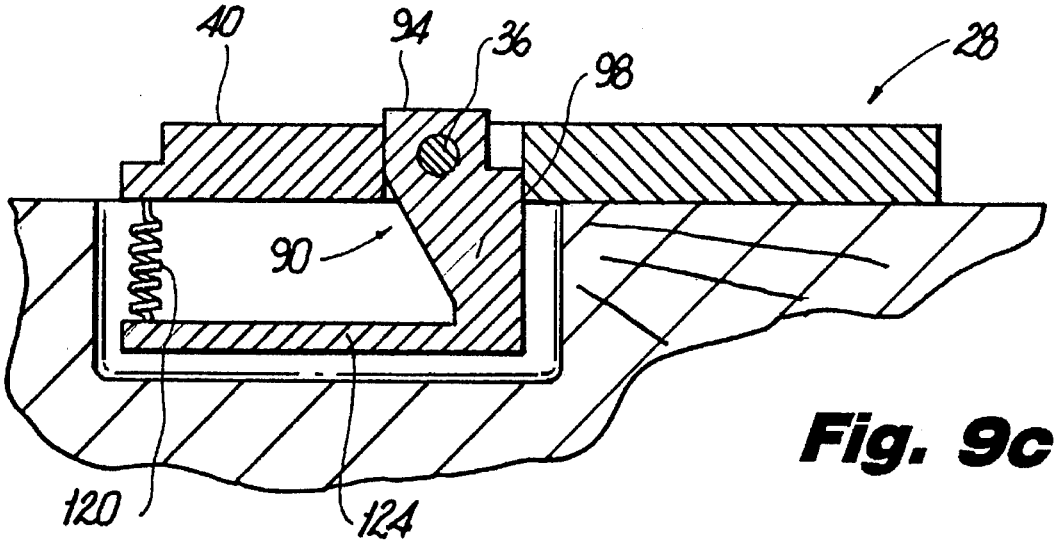

A tremolo device 24 according to further embodiments of the invention, as shown in FIG. 9, includes the essential elements of the apparatus previously described with like numerals denoting like parts. However, in these embodiments the biasing means of the crank assembly is provided by one or more of a variety of helical tension springs 120 connected at one end to the crank assembly and opposite ends thereof to the base plate 28 or the biasing plate 40. More specifically, as seen in FIG. 9*a*, the base plate 28 may have a shoulder 122 depending from the lower surface perpendicularly thereof to which the end of the springs 120 are secured. In FIG. 9*b* the crank element may be provided with an arm 124 such that it extends in a direction parallel to the strings 20 and the spring 120 secured transversely between the arm 124 and the base 28. A wall 126 is provided extending parallel to the spring 120 to act as a stop for the crank movement. In FIG. 9*c* the arm 124 is oppositely disposed and the spring 120 attached to the base plate 40. In each instance, the L-shaped body is correspondingly shaped to provide the appropriate bell crank function.

As seen in FIG. 9*a*, the spring 120 is set to keep the horizontal leg 98 of the crank 90 against the base plate 28, countering the tension of the string 20 by preventing the biasing plate 40 from moving. Rotation of the biasing plate 40 in the clockwise or counterclockwise direction results in a lowering of the string pitch mode or raising of the string pitch mode, respectively, as described earlier. A similar effect is obtained with the embodiment shown in FIGS. 9*b* and 9*c*.

Figure 10A:
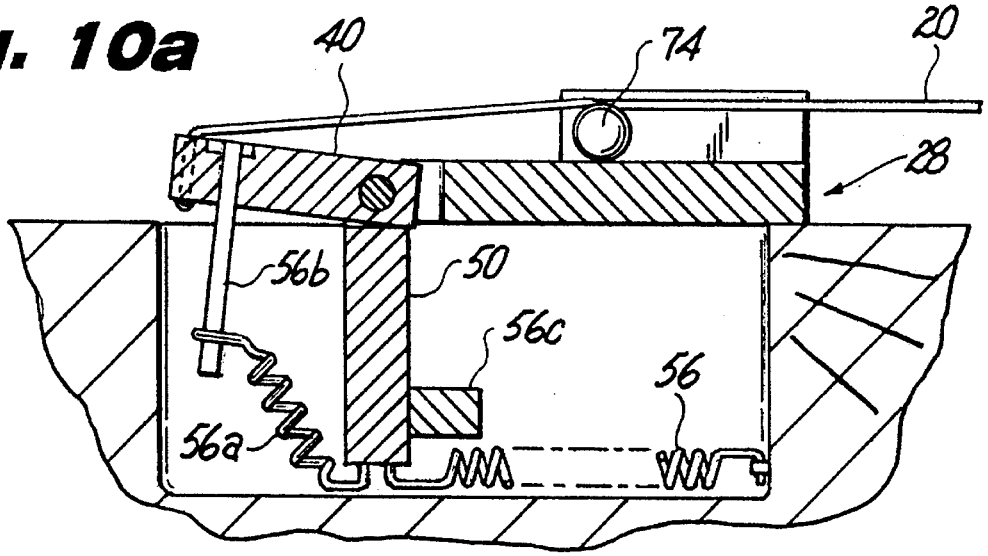
FIGS. 10*a*–10*c* are cross-sectional views similar to those if FIGS. 8*a*–8*c* showing a fourth embodiment of a tremolo device in accordance with the present invention.
Figure 10B:
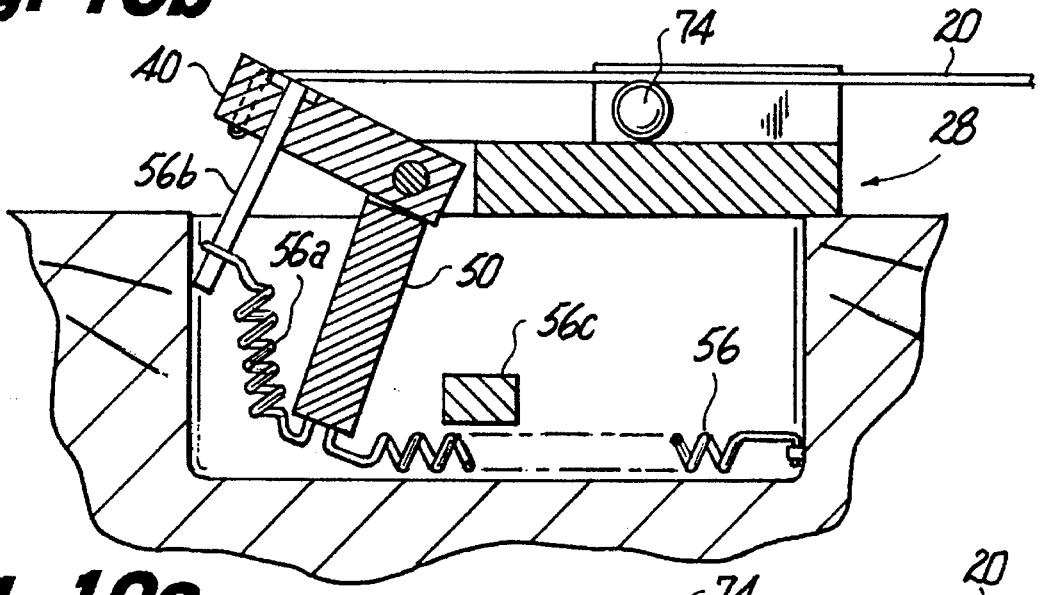
Figure 10C:
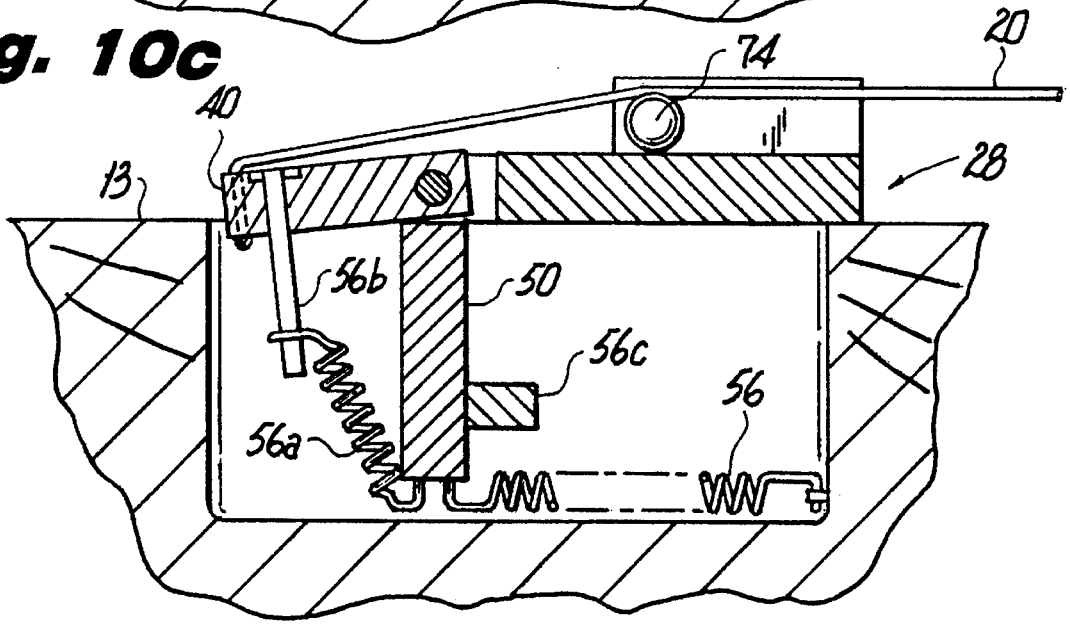

FIGS. 10*a*–10*c* illustrate modifications to the structure shown in FIG. 3, in which a second spring 56*a* is attached at one end to the depending block 50 and at its opposite end to the biasing plate 40, via an intermediary holding rod 56*b*.

The holding rod 56b is secured at its upper end to the biasing plate 40 and depends therefrom into the well 54. In addition, a stop block 56c is mounted in the well 54 so that it causes the depending crank block 50 to abut it and stop in a substantially vertical position.

In operation, the embodiment of FIGS. 10a–10c operate identically to that of FIG. 3 and the other embodiments except that the additional spring 56a provides additional tension force.

From the foregoing description, it can be seen that the present invention comprises an improved tremolo device for stringed instruments. It will be appreciated by those skilled in the art, that changes could be made to the embodiments described in the foregoing description without departing from the broad inventive concept thereof. It is understood, therefore, that this invention is not limited to the particular embodiments disclosed, but is intended to cover all modifications which are within the scope and spirit of the invention as defined by the appended claims.

What is claimed is:

1. A tremolo device for adjusting the string tension in a stringed musical instrument including a body having an upper surface, a neck portion, a tuning head having a plurality of tuning devices, a plurality of strings each anchored at a first end to a respective one of said plurality of tuning devices and extending over at least a portion of said neck portion and said body, said tremolo device comprising:

a) a base plate attached to said body;

b) a movable plate having first and second edges extending perpendicularly to said strings, said movable plate including means along said first edge for anchoring the second end of each of said strings, said base plate comprises a body and a pair of arms extending perpendicularly to said body and defining a channel, said arms including a pair of aligned holes opening into said channel, said movable plate having a bore extending along said second edge, said movable plate extending into said channel of said base plate with said bore in longitudinal alignment with said aligned holes in said pair of arms;

(c) means for pivotally mounting said movable plate on said base plate along said second edge of said movable plate about a pivot axis and in a horizontal position with its longitudinal axis perpendicular to said strings, said tuning devices being manually operable to apply a preselected tension force to each of said strings to stretch the associated strings between itself and said movable plate for tuning purposes, said preselected tension forces biasing said movable plate in a first direction of rotation about said pivot axis;

(d) biasing means connected between said base plate and said movable plate for biasing said movable plate about said pivot axis in a second direction of rotation opposite to said first direction, said movable plate having a primary position defined by the counteracting tension forces applied to it by said strings and by said biasing means at which primary position said strings carry primary tension force values and have primary pitch values; and (e) a manually operable actuating arm attached to said movable plate, whereby upon rotation of said actuating arm to rotate said movable plate in said first direction about said pivot axis to vary the tension forces and pitches of said strings from said primary values, said biasing means biases said movable plate in said second direction of rotation to return said movable plate to said primary position.

2. The tremolo device according to claim 1, wherein said pivoting mounting means comprises a pivot rod extending through said bore in said movable plate and into said aligned holes in said pair of arms of said base plate.

3. The tremolo device according to claim 2, wherein said body portion of said base plate includes a plurality of slots along its upper surface extending in a direction parallel to said plurality of strings, each of said slots having a threaded opening extending perpendicularly therethrough, said body portion further including a plurality of saddles, each of said saddles being removably secured to a corresponding one of said slots, each of said saddles being provided with a string supporting surface, each of said plurality of strings extending from said first edge of said movable plate over said string supporting surface of a respective one of said saddles and to a respective one of said tuning devices.

4. The tremolo device according to claim 3, wherein said anchoring means comprises:

a plurality of retaining slots along said first edge of said movable plate extending from said upper surface to said lower surface of said movable plate, each of said retaining slots including a base portion in radial alignment with a corresponding one of said string supporting surfaces on said saddle; and an anchoring element coupled to said second end of each of said plurality of strings and engaging said lower surface of said movable plate as each of said strings extends through a respective one of said retaining slots.

5. The tremolo device according to claim 4, wherein each of said saddles further comprises:

a saddle body;

a roller supported by said saddle body for rotation relative to said saddle body about an axis extending in a direction perpendicular to said strings, said roller having a peripheral annular notch defining said string supporting surface and a pair of guide surfaces on opposite sides of said annular notch extending upwardly therefrom to limit movement of said string away from said string supporting surface;

means for adjusting the position of said saddle laterally along said upper surface of said base plate in a direction parallel to said plurality of strings; and means for adjusting the height of said saddle and varying the height of said string supporting surface from said upper surface of said base plate.

6. The tremolo device according to claim 5, wherein said saddle body includes a recess defining two arm portions and a connecting portion, and further comprising a threaded element extending through said recess and in threaded engagement with said threaded opening in a corresponding one of said slots on said top surface of said base plate to firmly secure said saddle body to said base plate, said recess, said threaded element and said slot defining said lateral position adjusting means.

7. The tremolo device according to claim 6, wherein said connecting portion includes a threaded opening extending perpendicularly therethrough, and said height adjusting means comprises an adjusting screw threaded into said threaded opening on said connecting portion and extending into said corresponding one of said slots, whereby said adjusting screw can be rotated to vary the height of said string supporting surface relative to said top surface of said base plate.

8. The tremolo device according to claim 2, wherein said biasing means comprises:

a stop element including a main body having a bore extending therethrough and a leg portion extending perpendicularly from said main body;

a torsion rod defining said pivot rod, said torsion rod extending through said bore in said main body portion of said stop element in fixed relation thereof for biasing said stop element in said second direction about said pivot axis; and means for tensioning said torsion rod in said second direction.

9. A tremolo as set forth in claim 2, wherein said biasing means comprises:

a spring wound around said pivot rod; and means for tensioning said spring in said second direction.

10. The tremolo device according to claim 2, wherein said biasing means comprises:

a stop element having a main body portion including a bore extending therethrough and a leg portion extending perpendicularly from said main body, said pivot rod extending through said bore in fixed relation thereof; and at least one tension spring attached at opposite ends thereof to said base plate and said movable plate, said tension spring extending parallel to said strings.

11. The tremolo device according to claim 2, wherein said biasing means comprises:

a stop element having a main body portion including a bore extending therethrough, a leg portion extending perpendicularly from said main body and a shoulder portion extending perpendicularly from said leg portion, said pivot rod extending through said bore in fixed relation thereof; and a least one tension spring attached at opposite ends thereof to said base plate and said leg portion, said tension spring extending in a direction perpendicular to said strings.

12. The tremolo device according to claim 2, wherein said biasing means comprises:

a stop element having a main body including a bore extending therethrough and a leg portion extending in a direction perpendicular from said main body, said pivot rod extending through said bore in fixed relation thereof; and at least one tension spring attached at opposite ends thereof to said leg portion of said stop element and said movable plate, said tension spring extending in a direction perpendicular to said strings.

* * * * *